US008678253B2

(12) United States Patent
Graham

(10) Patent No.: US 8,678,253 B2
(45) Date of Patent: Mar. 25, 2014

(54) ERGONOMIC BACKPACK

(76) Inventor: David M. Graham, Jacksonville, FL (US)

( * ) Notice: Subject to any disclaimer, the term of this patent is extended or adjusted under 35 U.S.C. 154(b) by 22 days.

(21) Appl. No.: 13/293,270

(22) Filed: Nov. 10, 2011

(65) Prior Publication Data

US 2013/0119104 A1 May 16, 2013

(51) Int. Cl.
*A45F 4/02* (2006.01)

(52) U.S. Cl.
USPC ..... 224/155; 224/644

(58) Field of Classification Search
USPC ..... 224/644, 606, 627, 158, 159, 160, 161, 224/155, 156, 576, 625, 628, 907, 275; 190/115–118, 18 A
See application file for complete search history.

(56) References Cited

U.S. PATENT DOCUMENTS 3,679,108 A 7/1972 Ingram
5,573,155 A * 11/1996 Sadler ..... 224/155
5,573,166 A * 11/1996 Leja ..... 224/630
5,586,705 A 12/1996 Leonard
5,730,347 A 3/1998 Finot
5,788,032 A 8/1998 Krulik
5,894,977 A * 4/1999 Krueger et al. ..... 224/627
6,079,599 A 6/2000 Nordstrom et al.
6,332,566 B1 12/2001 Rota
D479,648 S 9/2003 DeLathouwer
6,843,398 B2 1/2005 Zion
6,997,507 B2 2/2006 Rhee
7,770,769 B2 8/2010 Hurn
7,775,334 B2 8/2010 Drew et al.
D632,502 S 2/2011 Gillespie
2007/0145090 A1* 6/2007 Hsu ..... 224/644
2007/0164064 A1* 7/2007 Nathan ..... 224/153
2008/0121674 A1* 5/2008 Yang ..... 224/644
2008/0245835 A1* 10/2008 Reid ..... 224/641
2009/0159622 A1* 6/2009 Smith ..... 224/153

* cited by examiner

*Primary Examiner* — Justin Larson
*Assistant Examiner* — Phillip Schmidt
(74) *Attorney, Agent, or Firm* — Robert H. Williams

(57) ABSTRACT

A backpack providing ergonomic support for the back and neck of the wearer. The backpack provides continuous, fully ergonomic cushioning support to provide optimal comfort to the wearer.

3 Claims, 4 Drawing Sheets

FIG. –1–

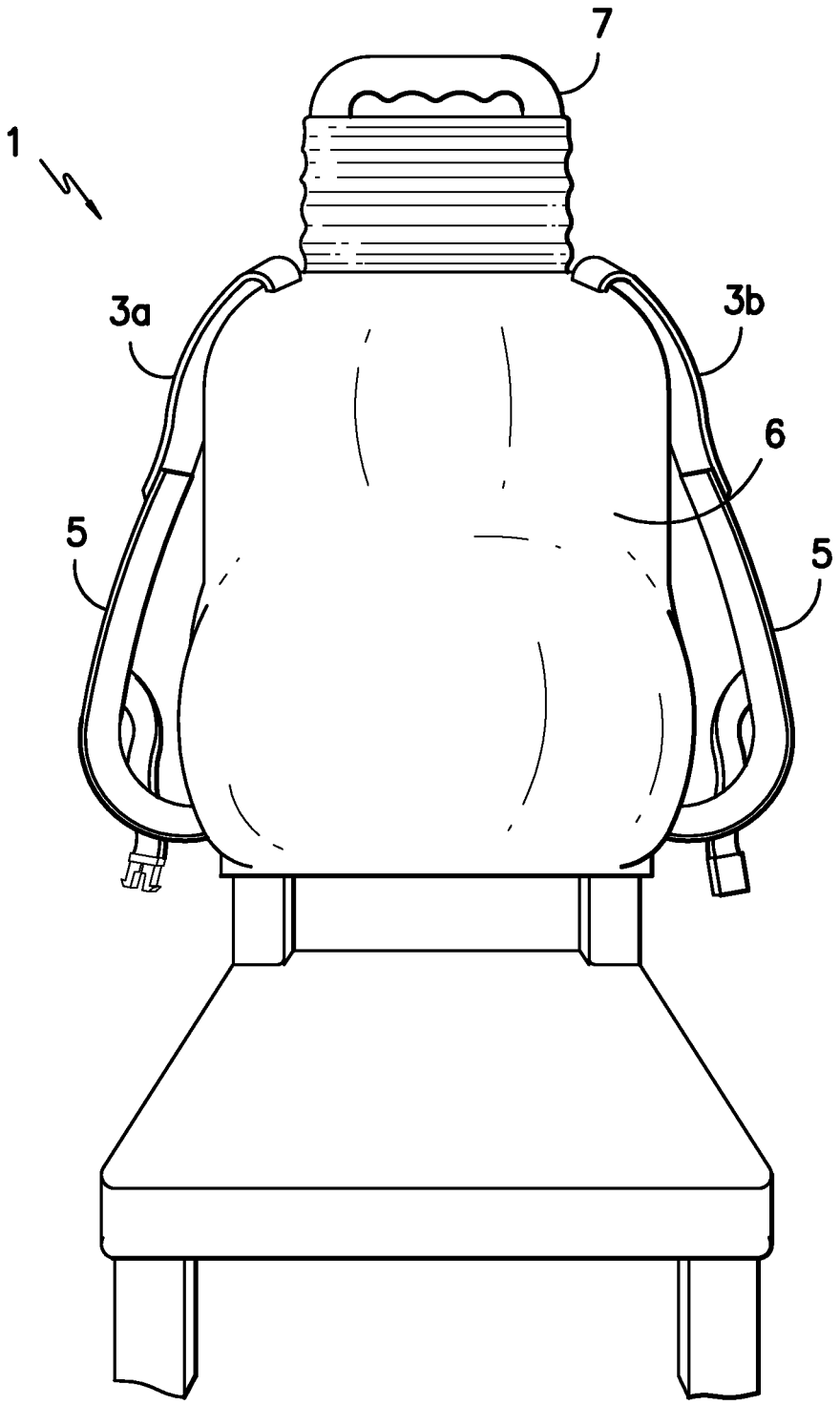
FIG. —3—

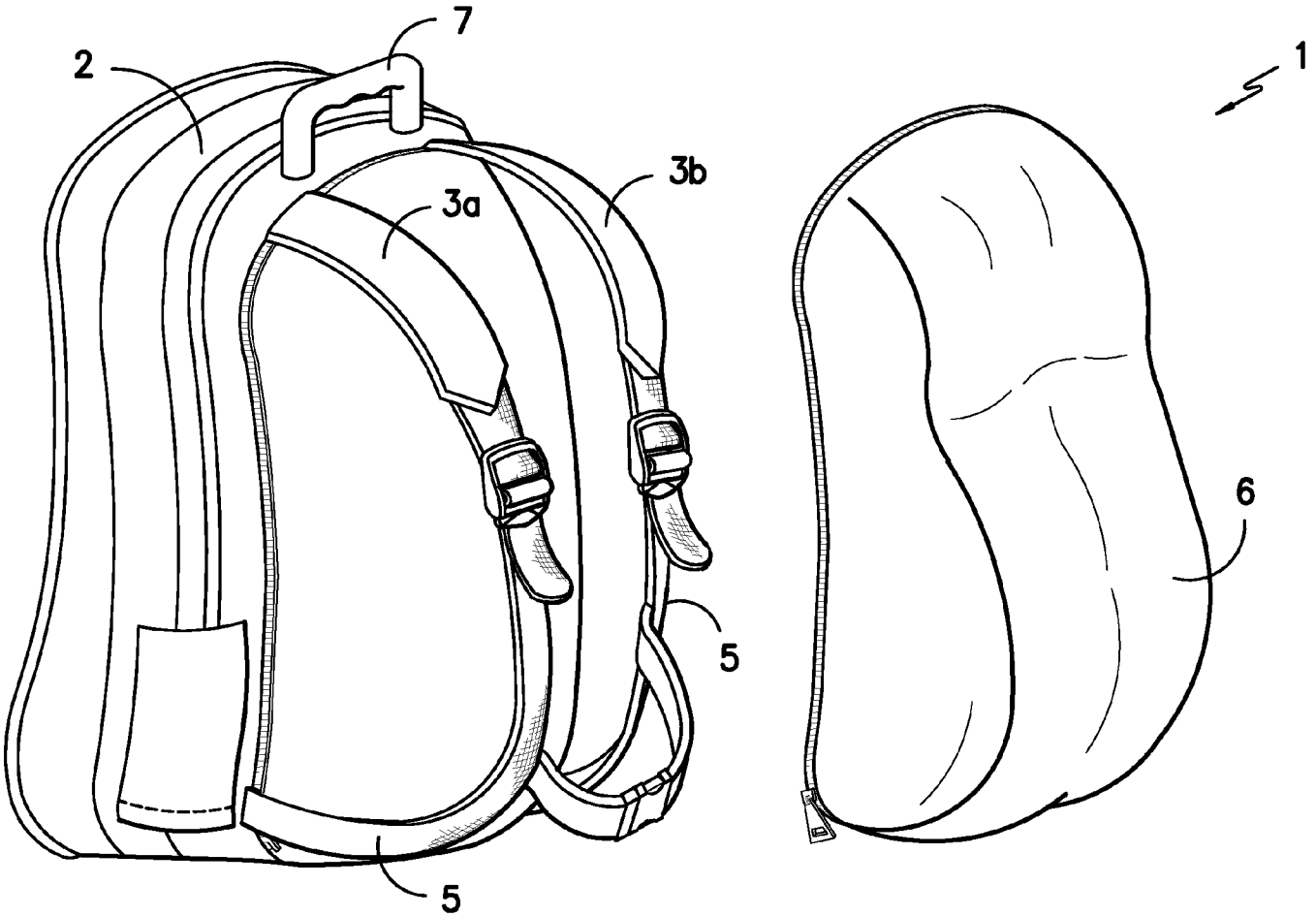
FIG. —4—

ERGONOMIC BACKPACK

BACKGROUND OF THE INVENTION

1. Field of the Invention

The present invention relates to a backpack providing ergonomic support for the back and neck of the wearer.

2. Description of Related Art

There are many previously known backpacks which include an assembly defining a chamber for carrying objects therein. This assembly typically includes several pieces assembled to form an enclosed chamber. Such pieces may include an inner panel, an outer panel, a lower panel, two side panels, and an upper panel. The known inner panel is configured to rest against the user's body when the backpack is worn, with the outer panel facing opposite therefrom. The known upper and side panels are configured to provide access to the interior space of the assembly. Commonly, this is accomplished by providing a zippered opening across the top and part of the sides of the backpack. Known backpacks generally include at least a pair of shoulder straps secured to the backpack allowing the chamber-defining assembly to be worn on the back of the user. This allows the user to carry objects around while his or her hands remain free for other tasks.

However, this also means that the combined weight of the carried objects and of the pack itself is supported by the user's back, shoulders, and neck. Known backpacks currently on the market typically offer little, if any, cushioning or support to the wearer's back and neck. Often, the weight of the known backpack and contents can be significant and creates strain on the wearer, especially when the backpack is worn for an extended period of time. This can be especially problematic for younger wearers of known backpacks, particularly school-age children.

Some known backpacks attempt to alleviate this situation through a strap or straps adapted to be fastened around the user's waist so that the total combined weight does not bear directly on the user's shoulders alone.

Some known backpacks provide limited cushioning support to the user. One such example is U.S. Pat. No. 5,894,977, Krueger et al. ("Krueger '977"), which discloses a backpack having segmented cushions with a limited user contact area. Krueger '977 provides a detailed description of many common features well known in the relevant art, the entire disclosure of Krueger '977 is hereby expressly incorporated by reference herein.

Krueger '977 teaches that it is desirable to provide padding while maintaining a low profile. Krueger '977 achieves this by providing wedge-shaped pads wherein the primary supporting portions are provided as reliefs projecting from the main body of the pads. Thus, the pads of Krueger '977 provide a contact surface of limited extent. Only the reliefs, which comprise a small portion of the width of the padding, are adapted to contact the user's back in the backpack taught by Krueger '977. The projecting reliefs of Krueger '977 are designed to provide cushioning only along the spine of the user rather than the full width of the back. Many users will find such padding provides only limited, ineffective support. For example, the intended users for such backpacks are predominantly school-age children. The pack of Krueger '977 would provide ineffective back support over the course of a school day if the child is fidgety and shifts from side to side.

Additionally, a key feature of Krueger '977 is the ability to include vibrational or thermal enhancements within the padding. In order to accomplish this, Krueger '977 provides two separate and discontinuous pads with a gap between them.

The space between the pads permits access to the lower pad to selectively install, remove, or otherwise access the vibrational and/or thermal accessories. Consequently, the pads of Krueger '977 provide discontinuous support over a limited extent of the backpack.

Another example of a known backpack is U.S. Pat. No. 6,843,398, Zion ("Zion '398"), which discloses a backpack including a supporting frame, commonly known as a rucksack. Zion '398 provides a description of several known features which may be advantageous to the invention of the present disclosure, the entire disclosure of Zion '398 is hereby expressly incorporated by reference herein.

BRIEF SUMMARY OF THE INVENTION

Disclosed herein is a backpack apparatus that provides ergonomic cushioning and support for the lumbar, upper-back and neck of the wearer. The disclosed backpack includes a continuous, fully ergonomic cushion to provide optimal comfort to the wearer. Unlike the backpack of Krueger '977, the backpack disclosed herein includes padding that is coextensive with both the height and width of the pack. Thus, the present disclosure provides an ergonomic backpack with a greater degree of support and comfort for the user.

Further, the backpack of the present invention can be supported by an external frame, such as a chair. This permits the disclosed backpack to provide the same extensive support to the user even when the user is not wearing the backpack. The disclosed backpack includes a pocket between the padding and the storage chamber with an opening at the bottom of the backpack. The opening is adapted to receive an external support member, such as the back rest of a chair, which can be enclosed within the pocket between the padding and the storage chamber. In this example, the user can enjoy the ergonomic benefits of the backpack while seated and with the weight of the backpack and its contents supported by the chair.

In some embodiments, the cushion of the present invention is removably attached to the storage chamber. This allows the cushion to be used separately and independently from the rest of the backpack. In such embodiments, the pocket adapted to receive an external support member is integral with the cushion so that the cushion may be detached from the support chamber and supported by an external frame.

An additional embodiment of the invention comprises an extendable head rest. The head rest of this embodiment is selectively positionable and can be retracted so as to be unobtrusive when not in use. When extended, the head rest provides additional support to the upper back, neck, and head of the user.

In a further embodiment, the disclosed backpack includes additional straps which are adapted to be secured to the user's belt loops.

In yet a further embodiment, the disclosed backpack includes means for attachment, which can be hook and loop fasteners, such as VELCRO, on the shoulder straps and side panels so that the shoulder straps may be secured to the side panels when the backpack is not being worn. For example, the shoulder straps may be secured to the side panels when the backpack is placed on the backrest of a chair.

In yet a further embodiment, the disclosed backpack includes a rolling wheel system. In this embodiment, the extendable head rest also serves as a handle for gripping the pack while it is rolled.

BRIEF DESCRIPTION OF THE DRAWINGS

FIG. 3 illustrates an embodiment of the present disclosure including an extendable headrest.

FIGS. 2 and 3 also illustrate an embodiment of the present disclosure wherein the straps and side panels include attachment means.

FIG. 4 illustrates an embodiment of the present disclosure wherein the cushion is removable from the backpack.

DETAILED DESCRIPTION

In the following description, relative terms such as "upper," "lower," "top," and "bottom" are with reference to the orientation shown generally in FIGS. 1-4, and relative terms such as "inner," outer," and "side" are with respect to the intended user, e.g., the intended meaning of the terms inner and outer is starting with the portion directly contacting the user as the innermost portion and moving outward (away from the intended user) therefrom.

As shown in the attached figures, the backpack 1 includes a storage chamber 2 with shoulder straps 3*a* and 3*b* attached thereto. The storage chamber 2 includes at least one zippered opening which extends across the top and a substantial portion of each side of the storage chamber. The opening provides access to the internal storage space of the storage chamber. It is also contemplated within the scope of the invention that said storage chamber could be divided into a plurality of storage compartments each having its own access opening. It is considered to be within the level of ordinary skill in the art to provide alternative closures other than zippers to the access opening or openings.

Attached to the storage chamber 2 is a cushion 6. The cushion 6 is coextensive with the storage chamber in both its width and its height. The cushion 6 is located generally opposite the access opening and is ergonomically profiled to support the back and neck of the user. The cushion 6 is attached to the storage chamber 2 along the top and side edges, defining a pocket 4. An opening between the bottom edges of the storage chamber 2 and cushion 6 provides access to the pocket 4.

The cushion 6 may be permanently attached to the storage chamber 2, such as by stitching. However, in an alternative embodiment, the cushion 6 is removably attached to the storage chamber 2, such as by a zipper as shown in FIG. 4. In the embodiment of FIG. 4, the pocket 4 is formed by a double panel on the outer (away from the user) face of the cushion 6, allowing the cushion 6 to be supported by an external frame independently of the storage chamber 2. As used herein throughout this application, the term "permanently attached" means not removable without substantial effort and/or damage to one or both of the storage chamber and cushion, and the terms "removably attached" or "temporarily attached" mean securely attached while removable with minimal effort and capable of being removed and reattached repeatedly.

The cushion 6 extends fully across the height of the storage chamber 2 such that it is configured to continuously cushion the user's back along the entire vertical extent of the backpack 1.

The cushion 6 extends across the full width of the storage chamber 2 and has a substantially uniform thickness, such that it is configured to provide full-back cushioning to the user.

Figure 2:
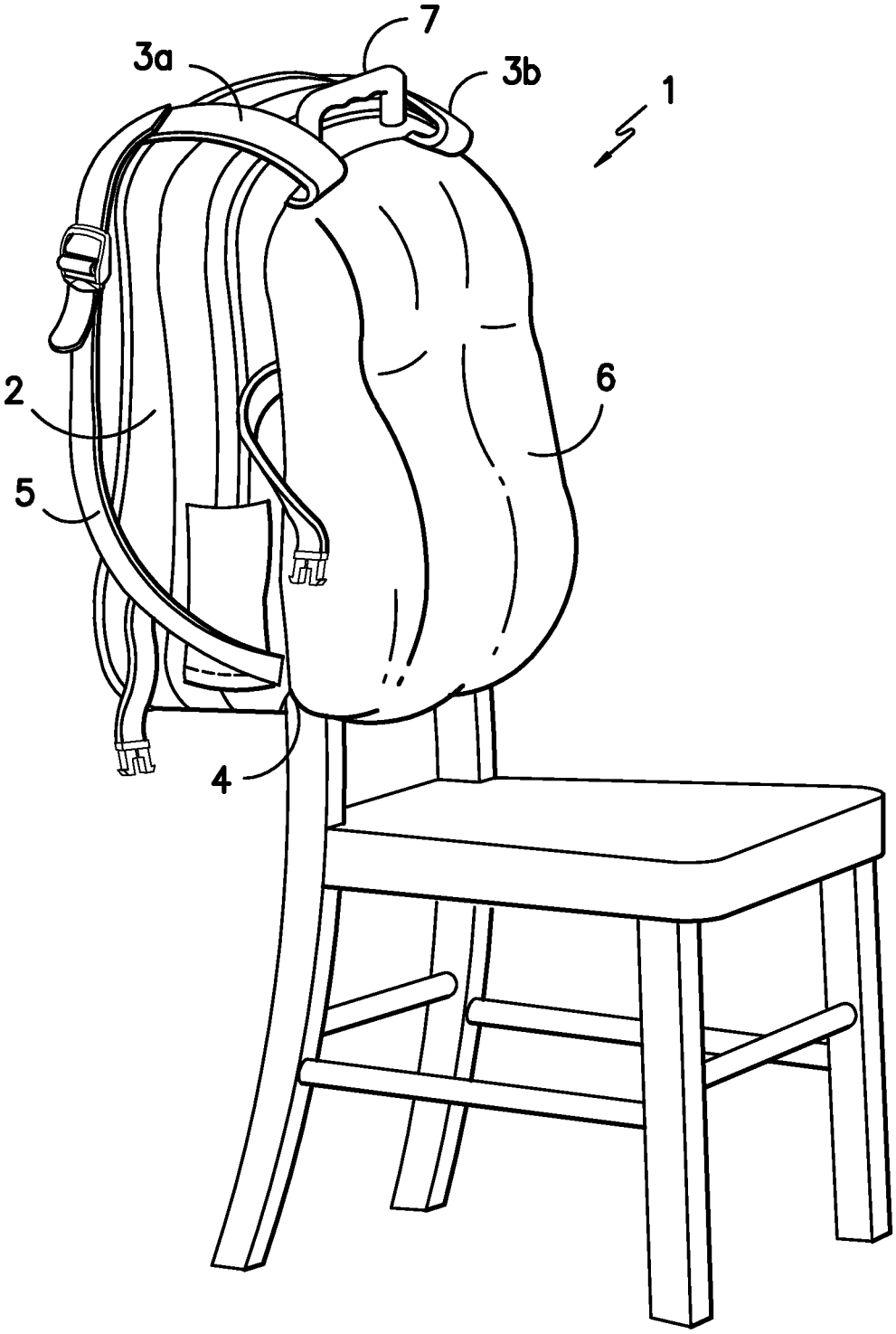
FIG. 2 illustrates one possible use for the disclosed backpack with an external frame, which is illustrated as a chair, supporting the backpack.

As shown in FIG. 2 and FIG. 3, the disclosed backpack can include means for attachment 5, which can be hook and loop fasteners, such as VELCRO, on the shoulder straps and side panels so that the shoulder straps may be secured to the side panels when the backpack is not being worn. For example, the shoulder straps may be secured to the side panels when the backpack is placed on the backrest of a chair.

Figure 1:
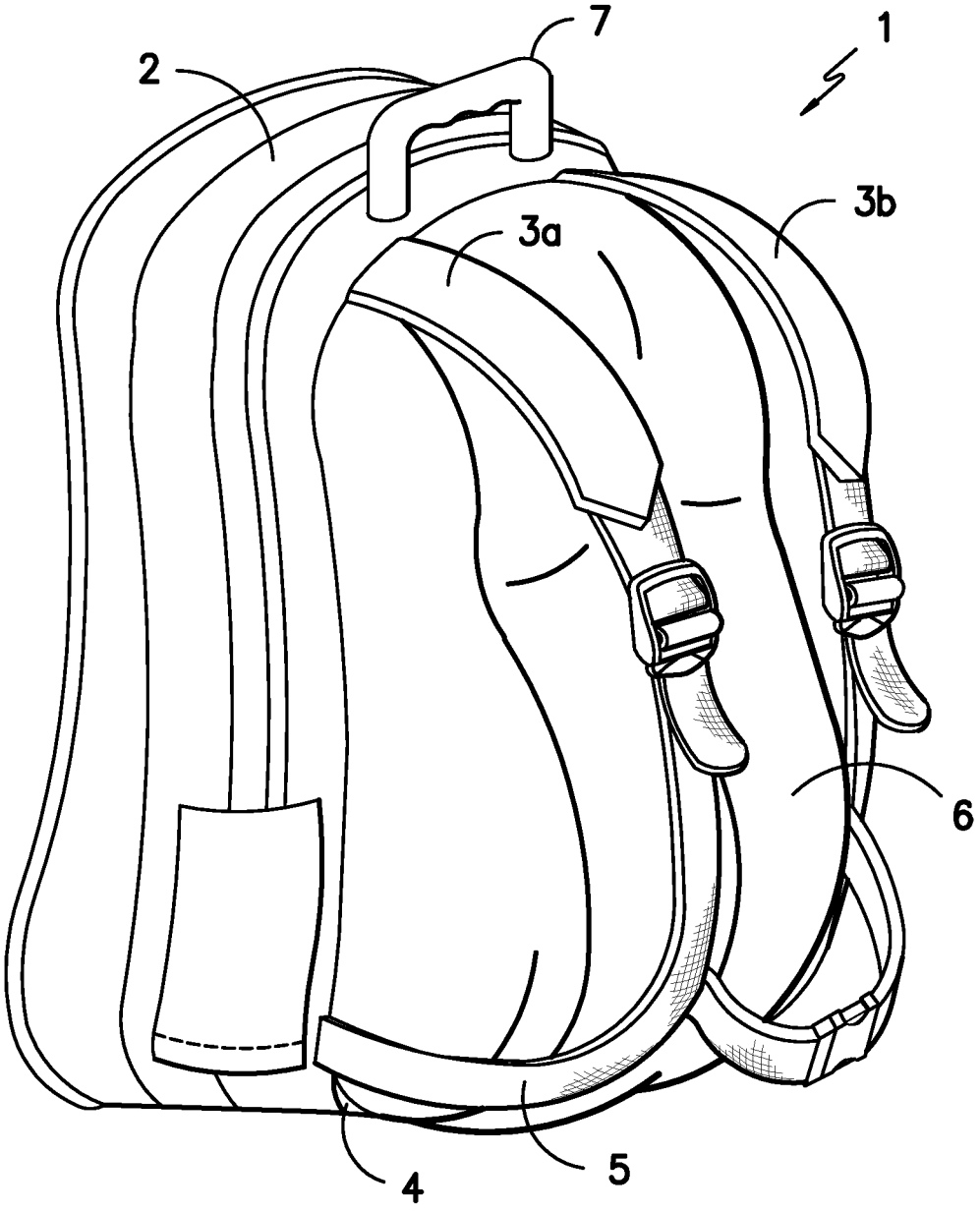
FIG. 1 is a perspective view of an embodiment of the backpack of the present disclosure.

In another embodiment of the disclosed invention, an extendable head rest 7 is provided at the upper portion of the storage chamber 2. The head rest 7 can be retracted so as to be unobtrusive when not in use, e.g., as shown in FIG. 1. When the head rest is extended, as shown in FIG. 3, the head rest can provide additional support to the upper back, neck, and head of the user.

The backpack of the disclosed invention may be provided with a rolling wheel system. In such embodiments, the extendable head rest is also configured to serve as a handle for gripping the backpack while it is rolled or carried by the user.

While preferred embodiments and example configurations have been shown and described, it is to be understood that various further modifications and additional configurations will be apparent to those skilled in the art. All such modifications and configurations are contemplated as being within the scope of the present invention. The specific embodiments and configurations disclosed are illustrative of the preferred and best modes for practicing the invention as defined by the appended claims, and should not be interpreted as limitations on the scope of the invention as defined by the appended claims. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

I claim:

1. A backpack adapted to be worn on a user's back, said backpack comprising:

a storage chamber;

one or more straps attached to said storage chamber configured to be worn around the torso of the user;

a cushion extending continuously across the full extent of the width and height of the storage chamber and configured to provide ergonomic support to the back, neck, and/or shoulders of the user;

means for temporarily attaching the one or more straps to the sides of the storage chamber, adapted to hold the one or more straps away from the cushion;

a headrest permanently attached to the backpack, near the top of the backpack, said headrest comprising a handle, a telescoping portion, and a covering;

wherein said handle, said telescoping portion, and said covering are all retractable and extendable with respect to said storage chamber.

2. The backpack of claim 1, further comprising:

a pocket between said storage chamber and said cushion, wherein said pocket is configured to receive an external frame, such as a chair.

3. The backpack of claim 1, wherein the cushion is removably attached to the storage chamber.

* * * * *